US006131216A

United States Patent [19]

Pine

[11] Patent Number: 6,131,216

[45] Date of Patent: Oct. 17, 2000

[54] METHOD AND APPARATUS FOR REMOVING HEAVY GASES FROM INFANT CRIBS

[76] Inventor: MacDonald Pine, 121 Greencastle Cir., Springfield, Ill. 62707-8723

[21] Appl. No.: 09/048,130

[22] Filed: Mar. 25, 1998

Related U.S. Application Data

[60] Provisional application No. 60/042,854, Mar. 28, 1997.

[51] Int. Cl.[7] ..... A47C 21/04; A47D 15/00

[52] U.S. Cl. ..... 5/93.1; 5/423; 5/424; 5/726; 5/946

[58] Field of Search ..... 5/424, 423, 726, 5/946, 724, 652.2, 284, 663, 93.1

[56] References Cited

U.S. PATENT DOCUMENTS

| | | | |
|---|---|---|---|
| 1,142,876 | 6/1915 | Davis et al. | 5/284 |
| 3,101,488 | 8/1963 | Peebles | 5/284 |
| 3,894,304 | 7/1975 | Burbidge et al. | 5/93.1 |
| 4,468,825 | 9/1984 | Hobbs | 5/284 |
| 5,483,711 | 1/1996 | Hargest et al. | 5/726 |
| 5,533,715 | 7/1996 | Dandrea | 5/93.1 |
| 5,546,618 | 8/1996 | Beedy et al. | 5/726 |
| 5,566,407 | 10/1996 | Lien | 5/663 |
| 5,592,704 | 1/1997 | Breese | 5/423 |

*Primary Examiner*—Alexander Grosz

[57] ABSTRACT

An infant container which may be in the form of a crib mattress and crib bumper assembly having means defining one or more gas flow channels which permit any concentration of heavy gases to drain by gravity from the upper surface of the crib mattress and be replaced by the environmental air of the room in which the crib is located. The gas flow channels may be defined by the crib mattress, the crib bumper or the structure of the infant container or may be defined by a structural element that elevates a conventional crib bumper above the upper surface of a conventional crib mattress and which defines at least one and preferably a multiplicity of gas drain channels. The heavy gases may be dissipated from the infant container by gravity induced gas flow. The system for removing heavy gas concentrations from the region of the upper surface of crib mattresses may also take the form of a mechanized system being suction operated or having air blowing capability for forcibly removing heavy gases from the upper surface region of the crib mattress so that the heavy gases are replaced by the environmental air of the room in which the infant container or crib is located.

10 Claims, 3 Drawing Sheets

FIG. 5
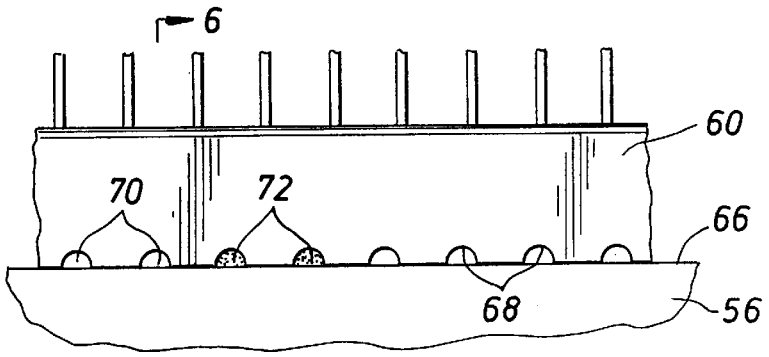
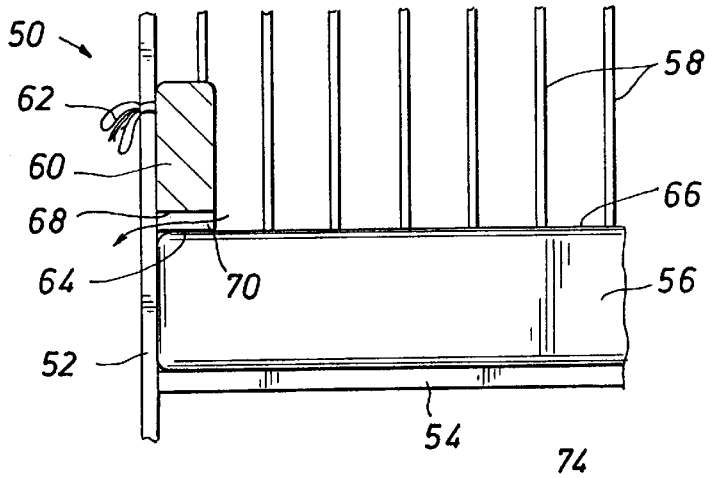
FIG. 6
FIG. 7
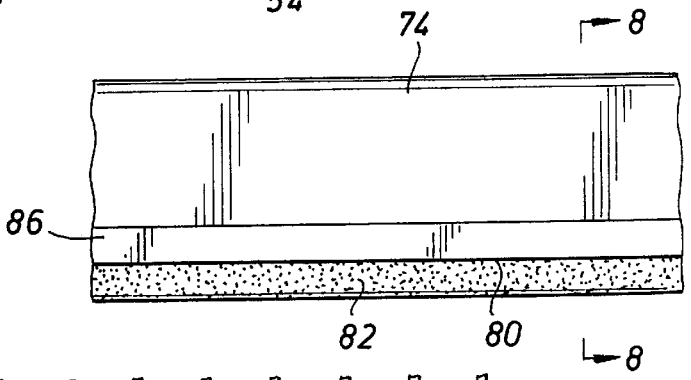
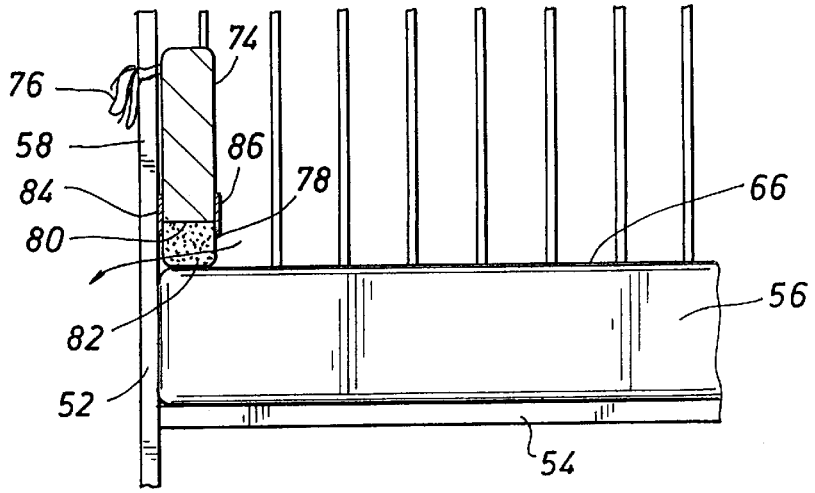
FIG. 8

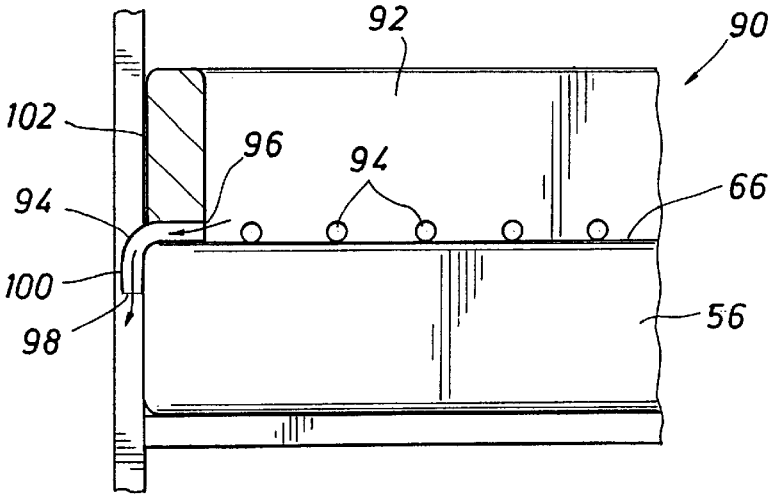
FIG. 9
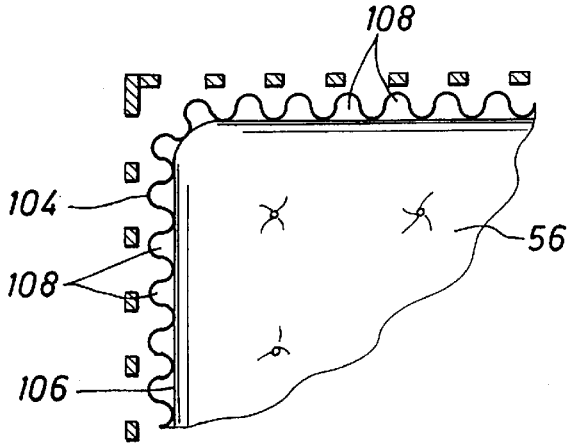
FIG. 10
FIG. 11
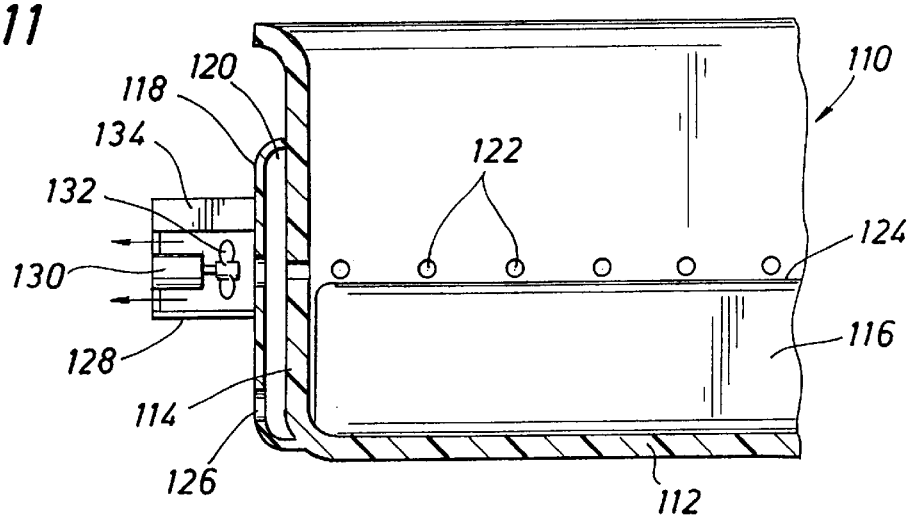

METHOD AND APPARATUS FOR REMOVING HEAVY GASES FROM INFANT CRIBS

Applicant hereby claims the benefit of U.S. Provisional Application Serial No. 60/042,854 which was filed on Mar. 28, 1997 by MacDonald Pine and entitled "Method And Apparatus For Removing Heavy Gases From Infant Cribs".

BACKGROUND OF THE INVENTION

1. Field of the Invention

This invention relates generally to infant cribs and more particularly to infant cribs having soft bumpers at the mattress edges thereof to protect infants from contact with vertical bars or other hard structures of cribs. More specifically, the present invention is directed to crib structures that define drain channels at the edges of a crib mattress for the purpose of draining away or otherwise removing any concentration of heavy, unhealthy or potentially non-life sustaining gas, such as carbon dioxide, that may otherwise be confined by the interfitting relationship of crib bumpers and mattresses, and thus permitting replacement of such heavy gases by the oxygen containing environmental air of the room in which the infant crib is located so that the air within the infant crib will be of essentially the same quality as the environmental air about the crib.

2. Description of the Prior Art

A typical infant crib is provided with a crib mattress and mattress support for comfortable support of an infant and is further provided with walls or vertical bars to confine an infant to the crib. To minimize the potential for discomfort or injury to an infant by contact with hard objects such as the walls or vertical bars of a crib, the crib is typically provided with bumpers for contact by infants. Typical crib bumpers are from about 6" to about 10" in height and are typically composed of a sponge rubber or polymer material having a thickness in the order of about 2" and having a suitable covering of material such as fabric, polymer sheeting or the like. Typically the lower edge of a crib bumper is straight so that it can seat on an edge of the crib mattress without forming any cracks that any part of the body of an infant, particularly a small or newborn infant can force its way into. The bottom edge of a typical crib bumper, in essence, establishes a seal with the upper edge surface of the crib mattress so that any concentrations of heavy gases cannot drain from the level of the upper surface of the crib mattress. Typically, crib bumpers provide a soft lining about the sides and ends of a crib and, in many cases, crib bumpers are defined by a continuous length of bumper material that is jointed in such manner that it defines corners matching the corners of the crib. Many crib bumpers are held in place by tie cords that are tied to the vertical bars of a crib.

One of the problems that has been found to exist with infant cribs that are fitted with crib bumpers is that in the region where an infant will lie, the region on and just above the mattress, the air circulation can be poor, especially when the crib is confined in a location that minimizes air drafts. The crib bumper, positioned about the edges of the mattress and virtually forming a seal with the mattress, defines a somewhat confined rectangular space, not unlike a shallow pool, which is open only at the top. If there is poor air circulation within the infant's room, which is often the case, a condition may exist where there is poor circulation or interchange of the air immediately about an infant lying on the mattress so that the oxygen supply to the infant may be inadequate for optimum healthy conditions. In the event concentrations of heavy gases are present within the "shallow pool" defined by the interfitting relation of the infant crib and crib mattress, the heavy gases may substantially exclude the typical oxygen containing air of the room, which is of less specific gravity as compared with the heavy gases, so that the infant is forced to "rebreathe" the heavy gases, carbon dioxide for example, to the exclusion of healthy air. This condition of inadequate oxygen supply may be exacerbated by the position of the infant on the mattress. For example, if the infant is lying on its back, the infant's nose and mouth will be located several inches above the level of the mattress, i.e., near the upper portion of the shallow pool where the quality of the air is better for efficient and healthful breathing. On the other hand, if the infant is lying on its stomach, with its head turned to one side, a typical position for infants, the nose and mouth of the infant will be located quite close to the mattress, i.e., near the bottom of the shallow pool where the quality of the air may not be adequate for healthful breathing. If the air within the shallow pool defined by the crib bumper system and the mattress is of less than adequate quality, the infant's health can be at least temporarily impaired by inadequate oxygen supply or by other aspects of poor air quality. The infant that is lying on its back will of course be infinitely better off, even in conditions of poor air quality, because the air near the upper portion of the shallow pool defined by the crib mattress and crib bumper will be of better quality as compared with the air at the bottom of the pool. Unfortunately, parents can seldom control the sleeping position of infants. Fortunately, many present day homes are equipped with air blowing heating, cooling and ventilating systems which sufficiently agitate and circulate the air within the rooms so that the shallow pool effect of a bumper lined crib may not result in detrimental air quality for the infant, and the air within the crib will be of virtually the same quality as the environmental air of the room.

It is well known that carbon dioxide and perhaps other gases that are breathed by animals, including humans, is of greater specific gravity, i.e., heavier than oxygen. It is known also that carbon dioxide is liberated from the lungs of all animals during the air interchange of breathing. Thus, if an infant is sleeping in the shallow pool of a bumper lined crib, and the conditions of air circulation and agitation are inadequate for sufficient displacement of carbon dioxide from the shallow pool, the oxygen content of the air within the pool may be insufficient for adequate health of the infant simply because of the high concentration of carbon dioxide in which the infant is located. Carbon dioxide is a non-life sustaining gas that, if breathed in conditions of insufficient oxygen or when the percentage of carbon dioxide to oxygen is too great, life of a human or other animal cannot be sustained long term. This condition, as explained above, can be worsened or made better by the position of the infants head while lying in the crib. The point is, well meaning parents may be inadvertently subjecting their infants to conditions of unhealthy air without knowing that the air being breathed by the infant is of poor quality as a result of the infant being confined for long periods of time within a shallow pool of a bumper lined crib.

Although the biological conditions causing Sudden Infant Death Syndrome (SIDS) have not been determined by the medical profession, to the knowledge of the inventor, it has been postulated that the air quality about a sleeping or lying infant may have some influence on the cause of SIDS. At present, however, there exists no medical evidence that heavy carbon dioxide concentration in an infant crib is a factor of causation for SIDS. It can be reasonably postulated as well however that in conditions of poor air circulation, the air in the shallow pool of a bumper lined crib may become of poor quality for breathing simply due to the continuous build-up of carbon dioxide being liberated from the lungs of an infant. It also seems logical that because of its specific gravity, carbon dioxide accumulating in the shallow pool of a bumper lined crib and displacing the oxygen that would otherwise be present in conditions of good air circulation, represents an undesirable characteristic from the standpoint of general health. Where a condition of carbon dioxide buildup exists, the longer the infant remains in such a condition, the worse the air quality will become. Thus, poor air quality due to the presence of excess carbon dioxide could be a cause or contributing factor to SIDS though no medical evidence exists at the present time, to the knowledge of the inventor, which might indicate that the presence of heavy gases could be a factor of causation from the standpoint of SIDS. The present invention therefore has, as its contribution to the health of infants, the provision of a system, or broadly means, for enhancing the quality of the air that is present in infant cribs by ensuring continual natural drainage or forceful removal of concentrations of heavy gases from the region of cribs at or near the level of the upper surface of the crib mattress so that the air breathed by infants will be of essentially the same quality as the environmental air of the rooms in which the cribs are located.

Although it is desirable to utilize crib bumpers for the benefits that they provide, it is also desirable to provide a means for ensuring air interchange into the confines of the bumper system to avoid the possibility of accumulating excessive carbon dioxide within the air that is available for breathing by an infant that is confined therein. It is also desirable to ensure against the development of an air containing seal between a crib bumper and a mattress of the crib so that heavy gases such as carbon dioxide will not become entrapped within the confines of the crib bumper and that such heavy gases will be caused to flow downward from the edges of the crib mattress, resulting in naturally occurring displacement of such heavy gases with air having essentially the same quality as the quality of the air of the home or room in which the crib is situated.

SUMMARY OF THE INVENTION

It is therefore a principal feature of the present invention to provide a novel infant crib or infant container assembly incorporating means for removal, by natural drainage or by power energized displacement, or therein; it is a feature of the present invention to provide a crib mattress and crib bumper assembly defining a plurality of drain channels permitting drainage of heavy gases from the edge portion of an infant crib and consequent displacement of such heavy gases with air from a room in which the infant crib is located;

It is another feature of the present invention to provide a crib mattress and crib bumper assembly wherein drain channels for heavy gases are defined by the crib bumper;

It is an even further feature of the present invention to provide a crib mattress and crib bumper assembly wherein drain channels for heavy gases are defined by the edge portion of the crib mattress;

It is also a feature of the present invention to provide a crib mattress and crib bumper assembly wherein drain channels for heavy gases are cooperatively defined by the edge portion of the crib mattress and the bottom configuration of the crib bumper;

It is another feature of the present invention to provide a crib mattress and crib bumper assembly incorporating apparatus positioned about edge portions of a crib mattress and which define multiple drain channels for directing the flow of heavy gases from the confines of the crib bumper; and It is an even further feature of the present invention to provide a crib mattress and crib bumper assembly having means defining discharge channels for discharge of heavy gases from the edges of a crib mattress and further having means for achieving positive displacement of such heavy gases and displacement thereof with good quality air for breathing.

Briefly, the various objects and features of the present invention are achieved through the provision of a crib mattress and crib bumper assembly having means defining one or more gas flow channels which permit any concentration of heavy gases to drain from the upper surface of the crib mattress and be replaced by the environmental air of the room in which the crib is located. The term "crib", as used herein is intended to encompass any container in which an infant may be located at any time, specifically including basinets and the infant containers that are typically used in medical facilities for containing newborn infants. The gas flow channels may be defined by the crib mattress, the crib bumper or both or may be defined by a structure that elevates a conventional crib bumper above the upper surface of a conventional crib mattress and which defines at least one and preferably a multiplicity of gas drain channels. The means for removing heavy gas concentrations from the region of the upper surface of crib mattresses may also take the form of a mechanized system for forcibly removing air and heavy gases contained therein from the crib so that it is replaced by the environmental air of the room in which the crib is located.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration of an infant crib liner incorporating the principles of the present invention and representing the preferred embodiment of the invention;

FIG. 2 is a plan view of an infant crib mattress for the infant crib of FIGS. 3 and 4;

FIG. 3 is an end elevational view of an infant crib having the crib liner of FIG. 1 situate therein;

FIG. 4 is a side elevational view of the infant crib and crib liner assembly of FIG. 2;

FIG. 5 is a fragmentary elevational view of an infant crib and crib bumper assembly representing an alternative embodiment of this invention and being designed for natural gravity induced drainage of heavy gas accumulation from a bumper lined infant crib;

FIG. 6 is a partial sectional view taken along line 6—6 of FIG. 5;

FIG. 7 is a fragmentary elevational view of a bumper lined infant crib assembly representing a another embodiment of the present invention;

FIG. 8 is a partial sectional view taken along line 8—8 of FIG. 7;

FIG. 9 is a fragmentary sectional view of an infant crib and crib bumpers assembly representing a further alternative embodiment of this invention;

FIG. 10 is a partial elevational view of an infant crib assembly having a heavy gas drain system incorporated about the periphery of the crib mattress thereof; and FIG. 11 is a partial sectional view of an infant container having a motor powered heavy gas removal system incorporated therewith.

DETAILED DESCRIPTION OF PREFERRED EMBODIMENT

Figure 1:
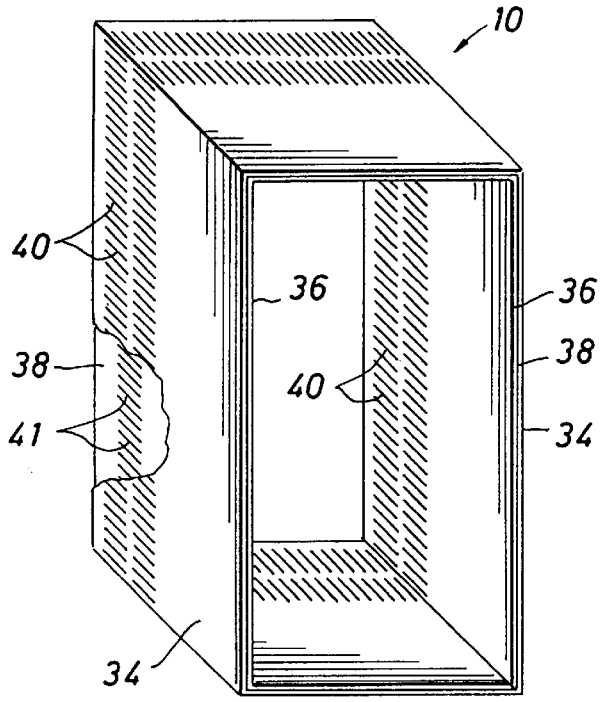
Figure 2:
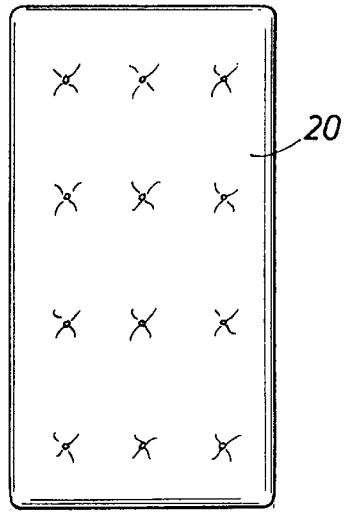
Figure 3:
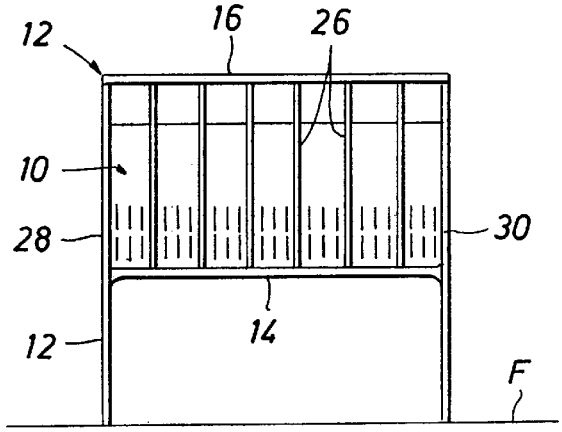
Figure 4:
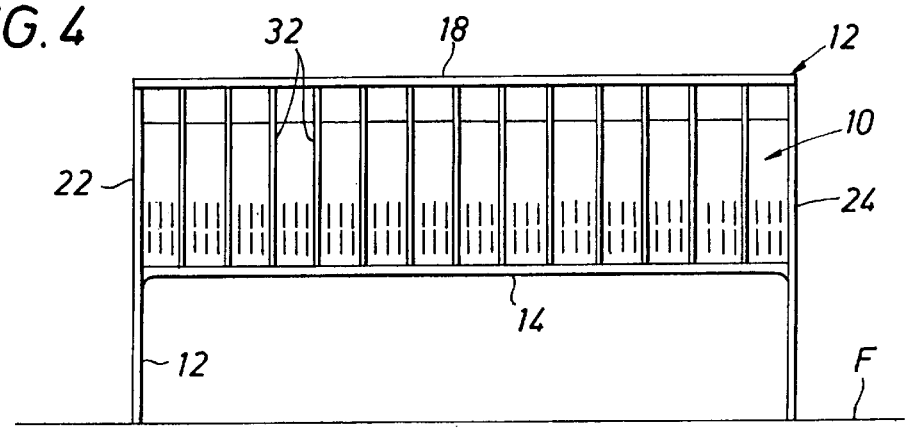

Referring now to the drawings and first to FIGS. 1–4 a crib liner is shown generally at 10 which is intended for positioning within an infant crib shown generally at 12 in FIGS. 3 & 4 having conventional crib legs or end frames 12 which position a horizontal mattress support 14 at an elevated position above a floor F on which the infant crib rests. The infant crib 12 defines upper end rails 16 and upper side rails 18 that are interconnected to define a rectangular upper extent of the infant crib. Typically the horizontal support 14 is of generally rectangular configuration and provides for support of a rectangular crib mattress such as is shown at 20 in FIG. 2. The end sections 22 and 24 of the infant crib are provided with multiple vertically oriented bars 26 as shown in FIG. 3, while the side panels 28 and 30 of the infant crib are typically provided with a multiplicity of spaced vertical bars 32. The vertical bars 26 and 32 are typically sufficiently closely spaced that even a small infant is substantially confined within the rectangular enclosure defined above the crib mattress by the side panels and end panels of the crib. More specifically, the spacing of these vertical bars is such as to prevent the head of even a small infant from passing between the bars.

The crib liner 10 is of generally rectangular configuration and is designed to be received in relatively close fitting relation within the rectangular confines of the infant crib as shown in FIGS. 3 and 4. In one form of the invention the crib liner 10 is defined by three closely spaced, interfitting, generally rectangular crib walls, being an outer wall 34, an inner wall 36 and an intermediate wall 38. Each of these three juxtaposed walls of the crib liner define a multiplicity of vent openings 40 which are arranged so that the vent sections of the intermediate crib liner wall 38 are disposed in offset relation with respect to the vent openings 40 of the inner and outer crib liner walls. Thus, though the various vent openings define gas flow passages from the inside crib liner to the outside thereof, these misaligned vent openings prevent direct flow of gas, i.e. drafts of air from the ambient environment about the infant crib, through the crib liner walls and onto the baby. Conversely, in the event of any accumulation of heavy gas, i.e. carbon dioxide within the infant crib and in the region of the upper surface of the crib mattress 20 the heavy gas, by virtue of its specific gravity, will drain naturally through the multiplicity of vent opening of the inner, outer and intermediate wall of the crib liner by virtue of the specific gravity thereof. As the heavy gas drains away from the interior of the infant crib in this manner, it is replaced by the air of the room or other environment in which the infant crib is located, which is drawn into the crib by the slight negative pressure conditions that is caused by drainage.

Another embodiment of this invention is shown in FIGS. 5 and 6 wherein an infant crib shown generally at 50 and having side and end walls 52 is provided with a mattress support 54 on which typically rests a crib mattress 56. The side and end walls of the crib mattress are defined in part by vertical bars 58 in the usual manner.

In many cases, to protect newborn and young infants from injury by the typically hard vertical bars 58 of an infant crib, a shallow rectangular liner is employed such as shown at 60, which is typically attached to vertical elements of the crib structure by tie straps 62 will be positioned with the lower surface portion 64 thereof resting on the upper surface 66 of the crib mattress at the outer peripheral portion of the crib mattress. According to the present invention vent means for insuring that any heavy gas accumulation within the lower region of the crib, just above of the upper surface of the crib mattress, can be efficiently removed by natural drainage or by a forcible gas removal system, the lower portion of the crib bumper 60 is scalloped as shown at 68 and thereby defines a multiplicity of small grooves that cooperate with the upper surface 66 of the crib mattress to define multiple gas drained channels 70. These drain channels are sufficiently small to exclude entry of the arm or leg of even a newborn or young infant. The drain channels are evenly spaced along the underside of the crib bumper 60 so that they are present about the entire outer periphery of the crib mattress 56. Thus, in the event of any accumulation of heavy gas in the region of the upper surface 66 of the crib mattress 56 this heavy gas will exit this region of the crib as shown by the flow arrow in FIG. 6. As the heavy gas exits by natural drainage due to its higher specific gravity as compared to air, fresh air will be caused to flow downwardly into the crib in replacement of the heavy gas, so that an infant, lying on the upper surface of the crib mattress will have a continuously replenished supply of fresh air. In the event the drain channels or passages 70 should develop an objectionable velocity of gas flow that creates an objectionable draft at the region of the outside edges of the crib mattress certain of the recesses or all of the recesses may be provided with filter material as shown at 72 in FIG. 5 so that continuous air drainage will be allowed to occur and yet the velocity of gas drainage will be restricted somewhat by the filter media 72 as desired for the gas drafts. As shown in FIG. 6, gas drainage channels 69 may be defined in the edge portions of the crib mattress to permit heavy gas dissipation from the mattress surface even when conventional non-channeled crib bumpers are employed.

A further alternative embodiment of the present invention is shown in FIGS. 7 and 8 which permits the use of a conventional crib bumper and yet provides for controlled heavy gas drainage from the region of the upper surface 66 of the crib mattress 56. A conventional crib is provided as shown at 74 which is connected to the side wall structure of an infant crib by means of retainer tie elements 76. These tie elements may simply be in the form of ribbons that are secured about the various vertical bars 58, or in the alternative, may conveniently take the form of hook and loop type fasteners such as are typically sold under the trademark Velcro.

To provide the infant crib with means for allowing continuous drainage of heavy gas such as carbon dioxide from the outer edge regions of the crib mattress, a gas drain device, shown generally at 78, is positioned about the lower edge 80 of the crib bumper. The gas drainage device 78 incorporates a perforate lower section 82 which defines a multitude of gas drain channels permitting efficient flow of heavy gas from the edges of the crib mattress 56 in the manner shown by the flow arrow. In order to establish an interfitting relation between the gas drainage device and the lower portion of the crib bumper 74, the gas drainage device is provided with one or more upperly projecting support flanges, such as shown at 84 and 86, between which the lower portion of the crib bumper 74 is located. These support flange elements will typically extend along the entirety of the lower portion of the crib bumper so that the crib bumper and the gas drainage device are essentially mechanically interlocked. The material 82 may conveniently take the form of an open polymer foam material that defines a multitude of minute gas flow passages to allow free flow of gas therethrough so that a heavy gas/air interchange can continuously take place. The upstanding flanges 84 and 86 may be defined by any suitable material that will restrict the lower portion of the crib bumper from lateral movement and also provide an environment that will be safe for contact by an infant. These upstanding flanges may be composed of a polymer material for lateral structural integrity and may be covered with a padded liner so as to protect an infant in the event that the gas drainage device is contacted by any portion of the infant's body. As shown at 83 in FIG. 8, the crib mattress may be defined at its upper edge portion to form heavy gas drainage channels in lieu of or in addition to the drainage channels that are defined by the crib bumper device 78.

A further alternative embodiment is shown in FIG. 9, generally at 90, wherein a crib bumper 92 having an upper portion of conventional design and construction, is provided with a plurality of heavy gas drain elements 94 at the lower portion thereof. These drain elements 94 may conveniently take the form of generally L-shaped tubular members having inlet openings 96 and outlet openings 98. The L-shaped construction of these heavy gas drain members is such that the lower depending sections 100 of each of the drain elements project outwardly beyond the outside edge 102 of the crib bumper 92 so that these lower sections 100 of the drain members also function as spacers to ensure that the gas drain passages cannot be come blocked by any bedding material that might be located externally of the crib mattress and crib bumper. Further, the downwardly directed outlet openings 98 of the drain elements further ensure that the gas flow passages always remain open so that efficient drainage of heavy gas can continuously occur as the heavy gas drains away from the upper mattress surface 66 through the drain passages and is continuously replaced by fresh air that is drawn into the interior of the infant crib by a natural gas displacement process.

With reference now to FIG. 10 about a crib mattress 56 may be located an elongate corrugated member 104 in the form of a strip and which cooperates with the outside edge 106 of the crib mattress to define a multiplicity of drain channels 108. Thus, heavy gas present at the outside edges of the crib mattress 56 will flow readily through the drain channels 108 thus causing fresh air to be drawn into the interior of the infant crib by the natural process of gas displacement.

When infants are treated in hospitals immediately after birth, they are typically placed within small infant containers or cribs having generally imperforate walls composed typically of a clear polymer to thus enable nursing personnel to observe the infants at all times. Since these imperforate container walls will typically prevent drainage of heavy gas from the interior infant receptacles concentrations of heavy gas such as carbon dioxide can build up therein as the result of infant's breathing activity. It is desirable to provide infant containers of this general character, which also incorporate means for ensuring removal of any heavy gas accumulation therefrom. As shown in FIG. 11 an infant receptacle for newborn infants is shown generally at 110 which has lower support wall 112 and side and end walls 114. A small lightweight infant pad 116 will typically be supported by the bottom wall 12 to provide for comfort of the infant within the enclosure. Either the bottom wall 112 or the side wall 114 or both will be provided with an exterior wall panel such as shown at 118 to thus define a heavy gas collection manifold chamber 120. The wall structure or the bottom wall as the case may be, will define a plurality of gas drain openings 122 which will be in communication with the manifold chamber 120. Thus, any accumulation of heavy gas within the infant container in the region of the upper surface 124 of the pad 116 can enter the peripheral manifold chamber 120 and drain away via drain openings 126. In the alternative, positive heavy gas displacement system may be provided. In this event, a fan housing 128 will be mounted externally of the wall 118. A fan motor 130 will be mounted within the fan housing 128 for rotation of a small fan 132 which can be powered by any suitable power and control system such as shown at 134. The fan motor 130 may be driven by an AC circuit if desired or may be fitted with a battery power system as the primary or backup motive source. The power of the electric motor 130 will be sufficient only to cause a gentle flow of gas/air from the interior of the receptacle through the openings 122 and into the manifold chamber 120 so that any heavy gas accumulation within the infant receptacle will be continuously and gently replaced with ambient air via a fan induced gas displacement process. The motive force of the motor and fan may be adjustable by the power and control circuitry 134 so as to establish a suitable heavy gas/air interchange that will always maintain the air within the infant receptacle at the same condition as the room in which the infant container is located.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for dissipating concentrations of heavy gases from the upper surface region of the mattress of an infant crib, by virtue of the higher specific gravity of such heavy gasses as compared with the specific gravity of environmental air, comprising:

positioning within the infant crib a bumper establishing with the crib mattress a plurality of gas flow channels located substantially at the level of the upper surface and at the edges of the mattress of the infant crib to facilitate gravity induced flow of heavy gases from the edges of the crib mattress of the infant crib.

2. The method of claim 1, wherein said gas flow channels being defined within the lower edge portion of the crib bumper, said method comprising:

positioning said crib bumper in contact with the upper surface of the crib mattress so that said gas flow channels of said crib bumper remain open and unobstructed.

3. The method of claim 1, wherein said gas flow channels are defined within the upper edge portion of the crib mattress, said method comprising:

positioning said crib bumper in contact with the upper surface of the crib mattress so that said gas flow channels of said crib mattress remain open and unobstructed.

4. The method of claim 1, wherein said gas flow channels are defined within a strip of material, said method comprising:

positioning said strip of material in interposed relation between the crib bumper and the upper surface of the crib mattress so that the crib bumper is elevated above the upper surface of the crib mattress and said gas flow channels of said strip of material remain open and unobstructed.

5. An infant container having a mattress defining an upper surface and having an edge portion, the infant container having an upwardly facing opening and having a wall structure being adapted for dissipation of heavy gases from the region immediately above the upper surface of the mattress thereof, comprising:

a bumper being located within the infant container and having a lower edge portion defining a plurality of recesses, said plurality of recesses defining a plurality of gas flow passages when the lower edge portion of the bumper is in engagement with the upper portion of the mattress, said passages adapted to permit gravity induced flow of heavy gasses from the container through said gas flow passages.

6. An infant crib having a mattress defining an upper surface and having an upper edge portion, the infant crib having an upwardly facing opening and having a wall structure being adapted for dissipation of heavy gases from the region immediately above the upper surface of the mattress thereof, comprising:

a plurality gas flow passages being defined in the wall structure of the infant container and being located in the region of the upper edge portion of the mattress to permit gravity induced flow of heavy gases from the container through said plurality of gas flow passages, a crib bumper being located within the infant crib; and a structural element being interposed between said crib bumper and the mattress and defining said plurality of gas flow passages said structural element defining a support for said crib bumper and elevating said crib bumper above the upper edge portion of the mattress.

7. An infant crib having a mattress support and defining side and end walls, wherein:

(a) a mattress is supported within said infant crib by said mattress support and defining an upper mattress surface and sides and ends and having an upper edge portion;

(b) a bumper element lining said side and end walls and being seated on the upper surface of said mattress along said sides and ends and along said upper edge portion; and (c) means defining a plurality of gas flow passages located substantially at the level of said upper surface of said mattress and adjacent at least some of said sides and ends and said upper edge portion of said mattress for gravity induced drainage of concentrations of heavy gases that night be present within said infant crib.

8. The infant crib of claim 7, wherein:

said bumper has a lower edge portion defining a plurality of recesses, said recesses defining said gas flow passages when the lower edge portion of the bumper is in engagement with the upper edge portion of the mattress.

9. The infant crib of claim 7, wherein:

a bumper support is interposed between said crib bumper and the mattress and defining said plurality gas flow passages, said bumper support defining a plurality of gas flow conductors extending between the crib bumper and the upper edge portion of the mattress and extending downwardly from said upper surface of the crib mattress.

10. The infant crib of claim 7, wherein:

a structural element being interposed between said crib bumper and the mattress and defining said plurality of gas flow passage means, said structural element elevating the crib bumper above the upper edge portion of the mattress.

* * * * *